US010638895B2

(12) United States Patent
Knudsen

(10) Patent No.: US 10,638,895 B2
(45) Date of Patent: May 5, 2020

(54) TOILET CLEANING DEVICE AND METHOD OF CLEANING A TOILET

(71) Applicant: Scrubb ApS, Hellerup (DK)

(72) Inventor: Stig Brammer Knudsen, Hellerup (DK)

( * ) Notice: Subject to any disclaimer, the term of this patent is extended or adjusted under 35 U.S.C. 154(b) by 116 days.

(21) Appl. No.: 16/063,275

(22) PCT Filed: Dec. 19, 2016

(86) PCT No.: PCT/EP2016/081729
§ 371 (c)(1),
(2) Date: Jun. 17, 2018

(87) PCT Pub. No.: WO2017/103265
PCT Pub. Date: Jun. 22, 2017

(65) Prior Publication Data

US 2018/0368632 A1 Dec. 27, 2018

(30) Foreign Application Priority Data

Dec. 18, 2015 (EP) ..... 15201185

(51) Int. Cl.
*A47K 11/10* (2006.01)

(52) U.S. Cl.
CPC ..... *A47K 11/10* (2013.01)

(58) Field of Classification Search
CPC ..... A47K 11/10
See application file for complete search history.

(56) References Cited

U.S. PATENT DOCUMENTS

| | | | | |
|---|---|---|---|---|
| 2,271,861 | A * | 2/1942 | Harris | A47K 11/10 15/210.1 |
| 2,648,085 | A | 8/1953 | Rogers | |
| 2,668,974 | A | 2/1954 | Jaeger | |
| 2,719,999 | A | 10/1955 | Hardin | |
| 3,319,281 | A | 5/1967 | Montgomery | |
| D297,467 | S | 8/1988 | McCann | |
| 5,471,697 | A | 12/1995 | Daconta | |

(Continued)

FOREIGN PATENT DOCUMENTS

| | | |
|---|---|---|
| DE | 29709610 U1 | 7/1997 |
| DE | 19857686 A1 | 6/2000 |

(Continued)

OTHER PUBLICATIONS

PCT Application No. PCT/EP2016/081729 International Search Report and Written Opinion, dated Feb. 16, 2017.

(Continued)

*Primary Examiner* — Randall E Chin
(74) *Attorney, Agent, or Firm* — Nora M. Tocups

(57) ABSTRACT

The present invention relates to a toilet cleaning device which comprises a handle, and a cleaning head, where the handle comprises an elongate shaft with opposite first and second ends and a longitudinal axis. The cleaning head comprises an upper surface, which connects to the second end of the handle, a lower surface opposite to the handle, and a lower rim which defines a plane, where the longitudinal axis of the elongate shaft forms an acute angle with the plane of the cleaning head, and wherein the lower surface comprises a cavity surrounded by a flange, on which flange the lower rim is defined.

6 Claims, 6 Drawing Sheets

(56) References Cited

U.S. PATENT DOCUMENTS

| | | | | |
|---|---|---|---|---|
| D487,164 | S | 2/2004 | Denton | |
| D524,545 | S | 7/2006 | Hinnant | |
| 7,131,783 | B1 | 11/2006 | DeRoma | |
| D587,844 | S | 3/2009 | Slavin | |
| D628,391 | S | 12/2010 | Knight | |
| D656,318 | S | 3/2012 | Zoghbi | |
| D694,484 | S | 11/2013 | Angel | |
| D728,118 | S | 4/2015 | Welt | |
| D739,146 | S | 9/2015 | Kossowsky | |
| D761,568 | S | 7/2016 | Harrington | |
| D832,585 | S | 11/2018 | Ebrahimi Afrouzi | |
| D834,835 | S | 12/2018 | Lee | |
| 2002/0007527 | A1 | 1/2002 | Hart | |
| 2004/0045112 | A1 | 3/2004 | Naumann | |
| 2005/0160523 | A1* | 7/2005 | Bixby | A47K 11/10 4/255.01 |
| 2012/0084933 | A1* | 4/2012 | Vetter | A47K 11/10 15/143.1 |
| 2012/0233800 | A1* | 9/2012 | Smets | A47K 11/10 15/207.2 |

FOREIGN PATENT DOCUMENTS

| | | | |
|---|---|---|---|
| DE | 20117675 | U1 | 2/2002 |
| DE | 202005011730 | U1 | 10/2005 |
| DE | 102010015434 | A1 | 10/2011 |
| DE | 202011109010 | U1 | 1/2012 |
| DE | 202011109041 | U1 | 1/2012 |
| EM | 000160130-0002 | A1 | 5/2006 |
| EM | 000374582-0001 | A1 | 7/2008 |
| EM | 001592031-0001 | A1 | 3/2009 |
| EM | 001595372-0001 | A1 | 3/2009 |
| EM | 001697426-0001 | A1 | 2/2011 |
| EM | 001841636-0004 | A1 | 4/2011 |
| EM | 001863317-0001 | A1 | 7/2011 |
| EM | 001912486-0001 | A1 | 9/2011 |
| EM | DM 099 701 | | 2/2018 |
| EP | 2052657 | A2 | 4/2009 |
| GB | 2362565 | A | 11/2001 |
| WO | 2000071012 | A1 | 11/2000 |
| WO | 02/056743 | A1 | 7/2002 |
| WO | 2002056743 | A1 | 7/2002 |
| WO | 2015097477 | A1 | 7/2015 |
| WO | 2017103265 | A1 | 6/2017 |

OTHER PUBLICATIONS

WIPO Hague International Registration No. DM/099701 dated Jun. 28, 2017 for Industrial Design for toilet brushes in the name of Scrubb Aps.

* cited by examiner

TOILET CLEANING DEVICE AND METHOD OF CLEANING A TOILET

CLAIM OF PRIORITY

The present application is a 371 national phase entry of international application PCT/EP2016/081729, filed Dec. 19, 2016, which claims priority to EP patent application number 15201185.4, filed Dec. 18, 2015, which are incorporated herein by reference in their entireties.

FIELD OF THE INVENTION

The present invention relates to a toilet-cleaning device, and to a method of sanitizing a toilet bowl using such a toilet-cleaning device.

BACKGROUND OF THE INVENTION

Widely available toilet cleaning equipment is generally limited to the toilet brush, a handheld device having a plurality of flexible bristles at a distal end. The toilet brush can be used to clean a toilet by reciprocally thrusting the brush against the inner surface of the toilet bowl, thus abrasively removing deposits, detritus and organic particulate matter.

Toilet brushes are typically kept adjacent to the toilet, so that users can clean the bowl should there be particularly heavy soiling. As a result, a toilet brush may have been used an indeterminate number of times between being cleaned. The bristles of the brush are also difficult to clean, there being a large surface area for deposits to adhere to and the bristles often becoming matted or intertwined. In combination, these factors quickly result in a build-up of dirt and bacteria on the surface of the toilet brush, which is unhygienic.

Additionally, the bristles of the toilet brush generally protrude radially from a central shaft, and therefore, to remove deposits on the toilet bowl, a vigorous scrubbing action must be performed, wasting time and energy. The bristles are also suboptimally aligned to clean under the rim of the toilet bowl, further allowing a build-up of dirt and bacteria in this area of the bowl.

WO 2015/097477 A1 discloses a toilet cleaning device for cleaning a toilet bowl, the toilet cleaning device comprising a handle; a head at a distal end of the handle; and a plurality of radially outwardly projecting helical blades which extend from a handle end of the head to a free distal end. As the head is rotated about an axial extent of the handle, the helical blades provide a circumferential and axial scraping action to the toilet bowl.

Due to the position of the head relative to the handle it is difficult to maintain a sufficient pressure against the surface to be cleaned. Further, when the helical blades must be used to remove dried in, sticky dirt it is difficult to apply necessary force via the head to the blades.

It is an object of the present invention to provide a solution to the above-mentioned problems.

It is a further object of the present invention is to provide a toilet cleaning device that improves the scrubbing ability. Further, it is an object to provide a toilet-cleaning device that allows a closer contact with the surface to be cleaned.

SUMMARY OF THE INVENTION

In a first aspect of the present invention, this object is achieved by providing a toilet cleaning device comprising a handle, and a cleaning head, where the handle comprises an elongate shaft, with opposite first and second ends, and a longitudinal axis, where the cleaning head comprises an upper surface connecting to the second end of the handle, a lower surface opposite to the handle, a transition-portion forming a transition between said handle and the upper surface of said cleaning head, and a flange extending outward from said transition portion, where the lower surface comprises an outer perimeter, the perimeter defining a plane of the cleaning head, where the longitudinal axis of the elongate shaft forms an acute angle with the plane of the cleaning head, and wherein a cavity is formed in at least a part of said lower surface of said cleaning head within said perimeter.

The cavity and the flange surrounding the transition portion of the cleaning head provides a flexibility of the flange that provides improved adherence to a surface to be cleaned, and the flexibility improves the scrubbing ability of the device and allows access to crevices in an efficient manner. Further the use of a cleaning head with a flange, rather than e.g. brushes provides a more sanitary device that may be easily rinsed, and thus do not introduce bad smell etc. The cleaning head being angled relative to the handle improves the accessibility of the device and makes it easier to reach all surface of a toilet bowl to be cleaned.

The flange preferably completely surrounds the transition portion. Further the flange is formed such that it is capable of flexing relative to the transition portion.

Further, the toilet cleaning device according to the present invention is easy to manufacture, and provides a simpler construction than the prior art devices.

In an embodiment the transition-portion of the toilet cleaning device forms a smooth, gradual transition between the handle and the upper surface of the cleaning head. Thereby, it is prevented that the device gets stuck in the crevices of a toilet bowl. Further the smooth transition prevents dirt from building up on the device.

In a further embodiment, one or more ribs are formed on the lower surface. The ribs are formed within the cavity. The ribs increase the scrubbing ability of the device.

In a further embodiment thereof, the cleaning head has a flat, elongate shape with a first longitudinal axis, the first longitudinal axis being parallel with both the plane defined by the perimeter (which is also the outer and lower rim of the flange), and the longitudinal axis of the shaft. The ribs are formed such that they intersect the first longitudinal axis of the head. Thereby, the ribs intersect also a primary direction of movement, when force is applied to the handle and the cleaning head is swept over a surface to be cleaned. The ribs thus being transverse to the movement, allows the ribs to rub over dirt stuck to the surface to be cleaned in a manner that will remove the dirt efficiently.

In an embodiment the one or more ribs are V shaped.

In a further embodiment, the cavity is formed in the lower surface opposite to the transition-portion and thereby opposite to the handle. Thereby, a pressure applied to the handle along the axis of the handle, and thus in a direction towards the surface to be cleaned, may force the flange to flex an thereby to evacuate the cavity of small portions of air, thereby creating a small vacuum, which will increase the ability of the device to stay close to the surface to be cleaned. Further, in embodiments where ribs are provided on the lower surface of the cleaning head, the ribs can very efficiently be forced to scrub over dirt on a surface to be cleaned, thereby removing the dirt. This latter effect is achieved irrespective of the former effect.

In yet another embodiment, the toilet cleaning device may additionally comprise a scrubbing knob formed on an upper surface of the flange. The scrubbing knob extends from the upper surface in a direction perpendicular to the plane, and in a direction towards the handle. Thereby it is obtained that the device may be used to simultaneously clean two opposed surfaces, such as two opposed surfaces of a water inlet of a toilet bowl.

Preferably, the scrubbing knob is formed in a position on the flange between the handle and the flange where the handle forms the acute angle with the plane of the cleaning head. Thereby, the scrubbing knob is located in a position on the toilet cleaning device, where the knob can be activated by a backward motion of the hand of a user, which makes it very easy to clean crevices facing away from the user, such as the water inlet crevice, which are otherwise very difficult to access and clean in a proper manner using prior art devices.

Additionally or alternatively, the toilet cleaning device (1), may in a further embodiment comprise one or more slits, formed in an edge of the flange. Thereby the flange may be divided into sections, which can move independently of each other and increase the adaption to the surface to be cleaned and access crevices more flexibly. Further, the slits may release a vacuum in the cavity if the cleaning head gets sucked to the surface to be cleaned.

Preferably, the handle is formed in a hard, rigid material. The material may be polypropylene, PP.

Preferably, the cleaning head is formed in a material which is softer and more resilient than the handle. The material may be a thermoplastic elastomer.

In one embodiment, the handle of the toilet cleaning device may additionally comprise a head core portion forming an extension of the elongate shaft at the distal end thereof, the head core portion extending into the cleaning head to form a connection thereto. Thereby, a particularly simple manufacturing method may be obtained.

In a further embodiment, the transition portion and the flange of the cleaning head are formed as one integrated piece. The transition portion and the flange of the cleaning head may be moulded onto the head core portion of the handle.

In any of the above described embodiments, the acute angle between the longitudinal axis of the shaft of the handle and the plane P is in the interval 30-60°, preferably in the interval 35-50°, and more preferably 45°.

In another aspect, the object of the present invention is accomplished by a method of cleaning a toilet bowl, the method comprising providing a toilet cleaning device, the toilet cleaning device comprising
- a handle, and
- a cleaning head the handle comprising an elongate shaft, with opposite first and second ends, and a longitudinal axis,
- the cleaning head comprising
  - an upper surface connecting to the second end of the handle,
  - a lower surface opposite to the handle,
  - a transition-portion forming a transition between the handle and the upper surface of the cleaning head; and
  - a flange extending outward from the transition portion;

the lower surface comprising an outer perimeter, the perimeter defining a plane, where the longitudinal axis of the elongate shaft, forms an acute angle with said plane, and where a cavity is formed in at least a part of the lower surface of the cleaning head within the perimeter;
- placing the lower surface against an inner surface of the toilet bowl;
- applying pressure to the handle in a direction towards the inner surface of the toilet bowl;
- moving the cleaning head over the inner surface of the toilet bowl; and
- entering a portion of the flange into a water outlet crevice of the toilet bowl.

The flange preferably completely surrounds the transition portion. Further the flange is formed such that it is capable of flexing relative to the transition portion.

The method according to the second aspect of the present invention may further comprise utilizing a toilet cleaning device further comprising any of the features defined by any of the embodiments described above.

Further objects, features, advantages and properties of the toilet-cleaning device and method according to the present invention will become apparent from the detailed description.

BRIEF DESCRIPTION OF THE DRAWINGS

The present invention will now be explained in more detail below by means of examples of embodiments with reference to the very schematic drawing, in which FIG. 1A, in a sectional side view, shows a toilet bowl with a toilet cleaning device according to the present invention placed against an inner surface of the toilet bowl in one position;

in FIG. 10A, the holder comprising a wall mount part and a holding part is shown; FIG. 10B shows a toilet cleaning device being inserted into a holder; and FIG. 10C shows a toilet cleaning device arrested in the holder.

DETAILED DESCRIPTION OF PREFERRED EMBODIMENTS

Figure 2:
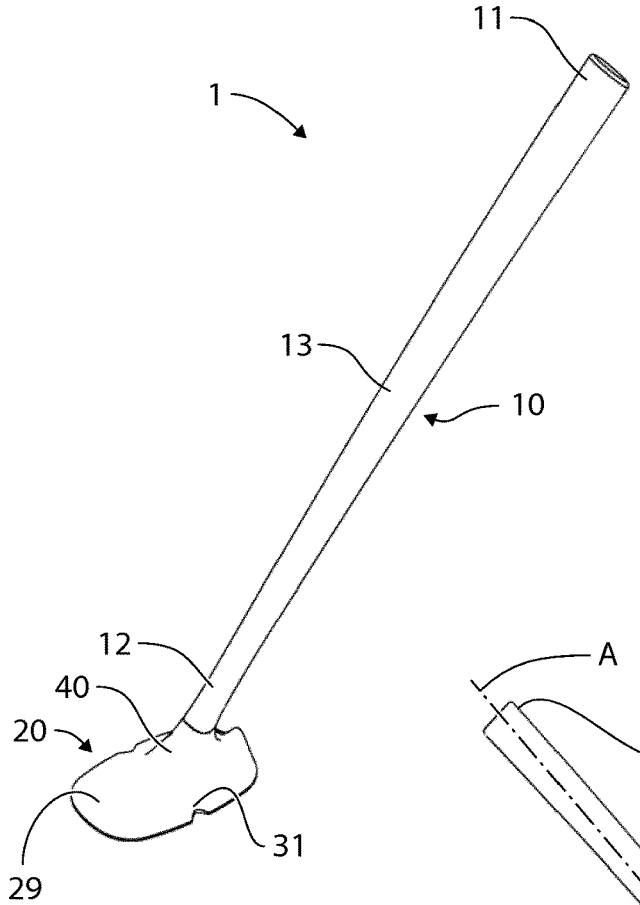
FIG. 2 is a perspective view of a toilet cleaning device according to an embodiment of the present invention.
Figure 3:
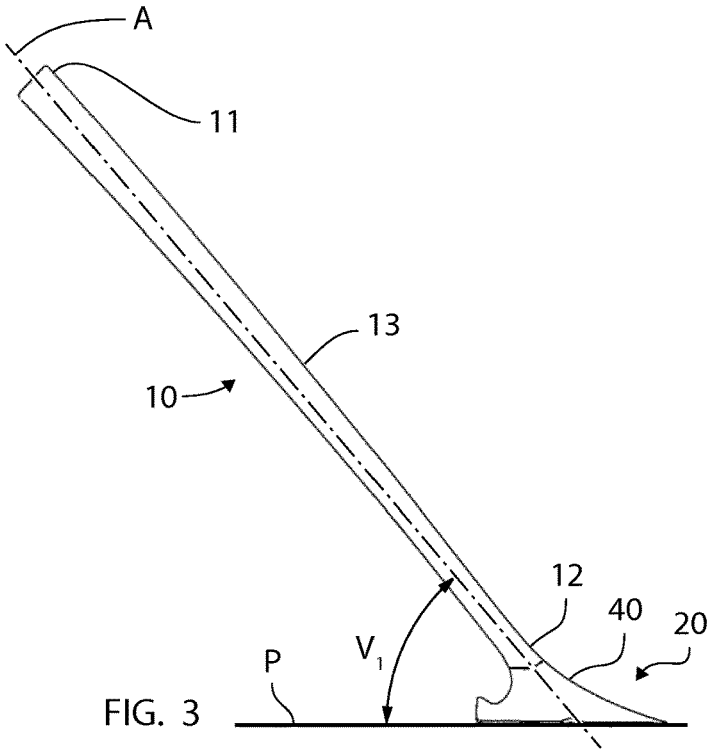
FIG. 3 is a side view of the toilet cleaning device shown in FIG. 2.

FIG. 2 shows a toilet-cleaning device 1 according to an embodiment of the present invention.

The toilet-cleaning device 1 comprises a handle 10 and a cleaning head 20. The handle 10 comprises an elongate shaft 13. The elongate shaft 13, and thereby the handle 10, has a first or proximal end 11 and a second or distal end 12, the first and second ends 11, 12 being provided at opposite ends of the shaft 13. The elongate shaft 13, and thereby the handle 10, has a longitudinal axis, A, in the longitudinal direction of the elongate handle.

The proximal end 11 of the shaft 13 is designed for a user to hold the handle 10. A special grip (not shown) may be provided on a portion of the shaft at the proximal end 11 thereof, to increase the users grip on the toilet-cleaning device during use. Further, in not shown embodiments, the grip on the handle 10 may be improved by providing portions of the handle 10 with a grating or special surface material, e.g. rubber or soft plastic in order to increase friction. In the embodiment shown, the handle 10 is provided with a smooth outer surface, which improves the hygiene of the toilet-cleaning device 1, as there are no cracks or fissures of surfaces where dirt may settle.

The cleaning head 20 is arranged at the distal (or second) end 12 of the handle 10, opposite to the proximal (or first) end 11 of the handle 10. The cleaning head 20 comprises an upper surface 21, where the cleaning head 20 connects to the second end 12 of the handle 10, and a lower surface 22, opposite to the upper surface 21. Thereby, the lower surface 22 is also provided on the side of the cleaning head 20, which is opposite to the handle 10. The lower surface 22 of the cleaning head 20 further comprises a lower (and outer) perimeter 27 defining a plane, P, at the side of the cleaning head 20 being defined by the lower surface 22.

The cleaning head 20 preferably has an overall flat plate-shaped structure, generally formed in the plane P.

The cleaning head 20 of the toilet-cleaning device 1 further comprises a transition-portion 40 forming a connection between the handle 10 and the cleaning 20. Further, the cleaning head 20 comprises a flange 29 connected to and extending outward from said transition portion 40. The flange 29 surrounds the transition portion 40. The flange 29 is flat. The flange 29 generally coincides with said plane P of the cleaning head 20 of the toilet cleaning device 1. The flange 29 has an outer and lower rim which coincides with, or is identical to, the perimeter 27 of the lower surface 22. Thus, it can be said that the perimeter 27 of the lower surface 22 is also the perimeter of the flange 29, or that it is defined thereon.

The flange 29 preferably completely surrounds the transition portion. Further, the flange 29 is formed such that it is capable of flexing relative to the transition portion.

To ensure that the cleaning head can better reach and scrub all parts of a toilet bowl 100, the cleaning head 20 and the handle 10 are angled with respect to each other, by the plane P forming an acute angle, V1, with the longitudinal axis, A, of the handle. Consequently, also an obtuse angle (V2, not shown) is formed adjacent the acute angle V1. Thus, the handle 10 is preferably not perpendicular to the plane of the cleaning head 20, i.e. V1≠90° (and V2≠90°). Also, it is not formed with the plane P extending in the same direction as the longitudinal axis of the handle 10 (i.e. V1≠0°).

In connection with any of the embodiments of the present invention described above or below, the acute angle V1 between the longitudinal axis, A, of the shaft 13 of the handle 10 and the plane P may be in the interval 30°-60°, preferably 35°-50°, more preferably 45°.

The lower surface 22 of the cleaning head comprises a cavity 28, formed within the perimeter 27. Thus the cavity is formed in the bottom surface of the flange 29 and the transition portion 40. In some embodiment the cavity 28 may be surrounded by the flange 29 of the cleaning head 20. The cavity 28 is formed as a concave indentation in the lower surface 22, and inside of the outer perimeter 27 of the lower surface 22 of cleaning head 20. The perimeter 27 thus is defined on the flange 29. The cavity 28 is formed such that it extends from the plane P and in the direction of the handle 10 and the upper surface 21, but does not extend through the cleaning head 20, i.e. it does not open into the upper surface 21.

The entire cavity 28 is formed on the side of the plane P (defined by the perimeter 27), where the handle 10 is arranged.

Figure 5:
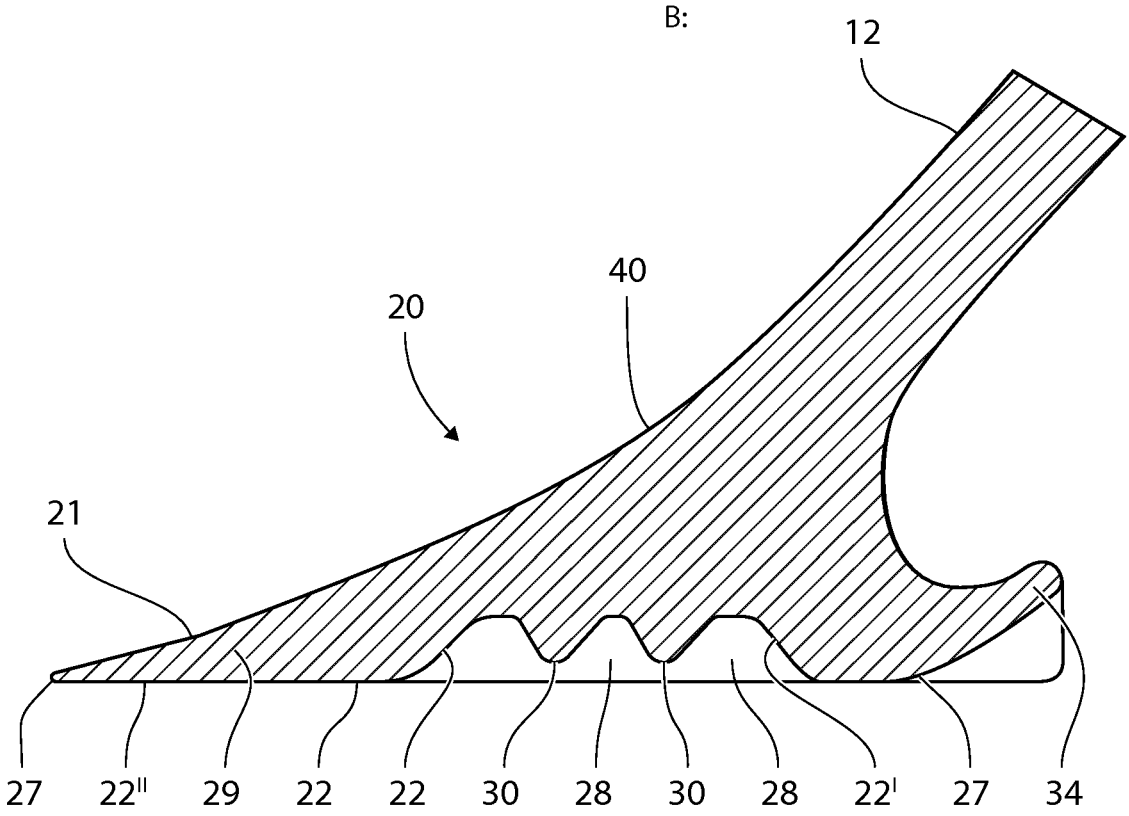
FIG. 5 is a side sectional view of details of a cleaning head and a part of a handle of a toilet cleaning device according to one embodiment of the present invention.
Figure 8:
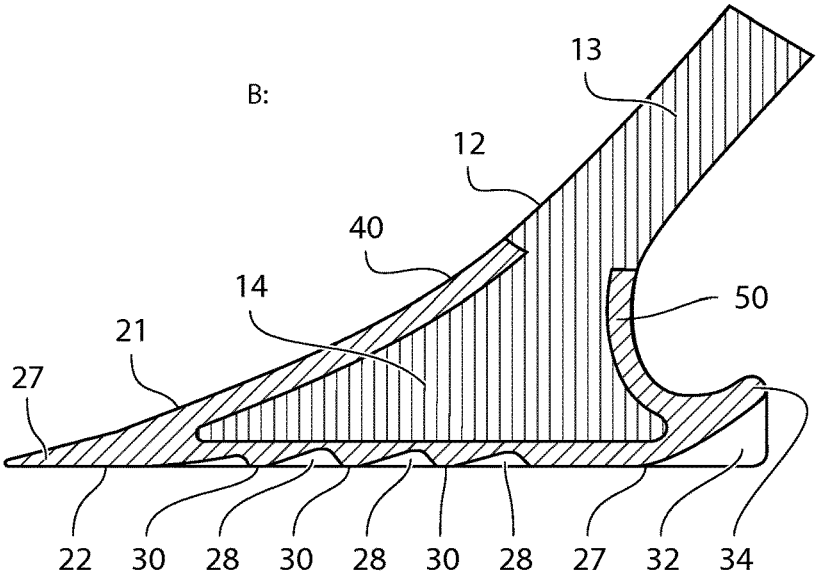
FIG. 8 is a side sectional view of the cleaning head and a part of a handle of a toilet-cleaning device according to another embodiment of the present invention.
Figure 9:
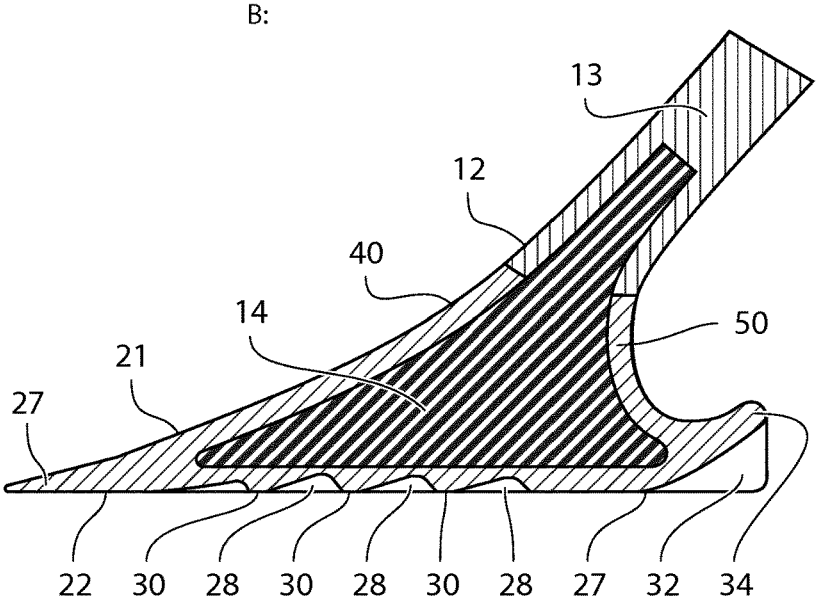
FIG. 9 is a side sectional view of a cleaning head and a part of a handle of a toilet-cleaning device according to yet another embodiment of the present invention.

In the embodiments shown in FIGS. 5, 8, and 9, the lower surface 22 has two portions, one cavity portion 22' defined within the cavity 28, and one flange portion 22" defined on the lower/distal side of the flange 29 surrounding the cavity 28.

However, in other embodiments the cavity 28 may extend all the way from the outer perimeter 27 (i.e. the outer and lower rim of the flange 29). Thus, the cavity 28 comprises the entire lower surface 28, i.e. the entire lower surface 28 of the cleaning head 20 is concave.

Figure 4:
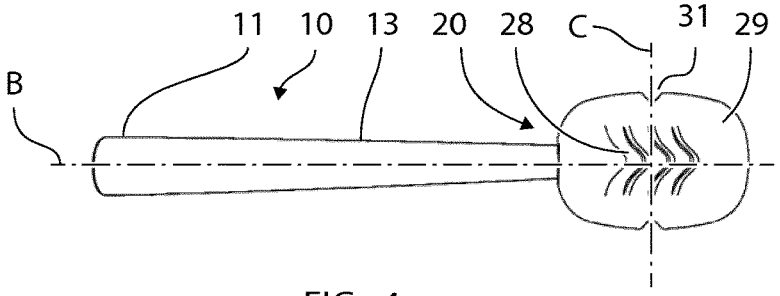
FIG. 4 is a bottom view of the toilet cleaning device shown in FIGS. 2 and 3.
Figure 6:
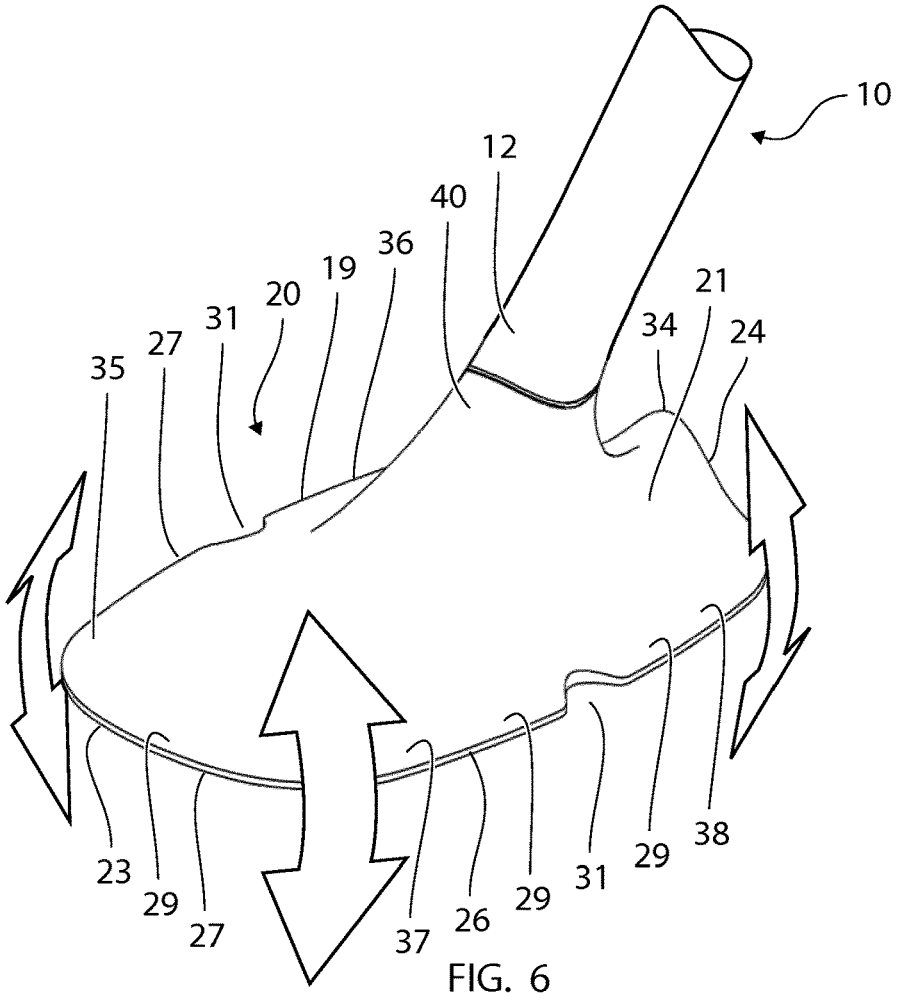
FIG. 6 is a perspective view of a cleaning head and a part of a handle of a toilet cleaning device according to an embodiment of the present invention, and seen from a proximal or upper side.
Figure 7:
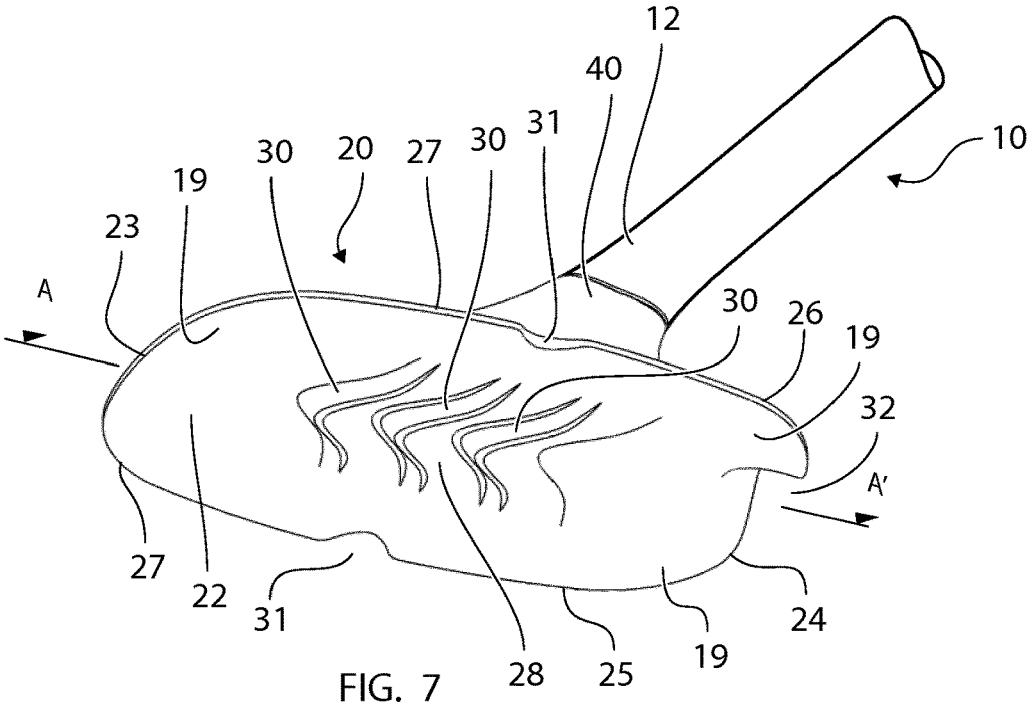
FIG. 7 is a perspective view of the cleaning head and part of a handle of a toilet cleaning device shown in FIG. 6, but from the distal or lower side.

In an embodiment, and as shown in FIGS. 4 and 6, one or more ribs 30 may be formed on the lower surface 22 within the cavity 28, i.e. within the cavity portion 22' of the lower surface 22. Preferably, the one or more ribs 30 are formed as elongate ridges extending from the lower surface 22 (i.e. in the direction towards plane, P). Preferably the whole of each of the ribs 30 is formed on the side of the plane P defined by the rim 27, where the handle 10 is arranged, i.e. they do not extend below the rim 27. This is shown in FIG. 5. However, the ribs may extend all the way to the plane P, as shown in FIGS. 8 and 9. The same to options for the extent of the ribs 30 may apply to embodiments, where the cavity 22 comprises the entire lower surface 22, i.e. where the entire lower surface 28 of the cleaning head 20 is concave.

As can be appreciated from e.g. FIG. 4, the shown cleaning head 20 preferably has a flat, elongate shape with a first longitudinal axis, B. The first longitudinal axis B of the head 20 is parallel with both the plane P defined by the rim 27, and the longitudinal axis A of the shaft 13 of the handle 10.

Also, the flat, elongate shape cleaning head 20 has a second longitudinal axis, C, the second longitudinal axis C being parallel with the plane P defined by the rim 27, and perpendicular with the longitudinal axis, A. Thereby, the second longitudinal axis is perpendicular to the first longitudinal axis B of the cleaning head 20.

Preferably, the extension of the cleaning head 20 in the direction of the first longitudinal axis, B, of the cleaning head 20 is larger than the extension of the cleaning head 20 in the direction of the second elongate axis, C, of the cleaning head 20. Preferably, the extent in the direction of the first longitudinal axis, B, is approx. 2:1 relative to the extent in the direction of the second longitudinal axis, C.

As seen in FIG. 4, the shape or profile of the cleaning head 20, seen from below, may be close to rectangular, but with rounded corners. The cleaning head 20 preferably being symmetrical around the first elongate axis, B, of the cleaning head.

Thus, the flange 29 of the cleaning head 20, has a front edge 23 and rear edge 24, which edges are formed in the general direction of the second elongate axis, C, of the cleaning head 20. It also has side edges 25, 26 formed in the general direction of the first elongate axis, B, of the cleaning head 20.

The front and rear edges are defined by the front edge 23 being located on the side of obtuse angle between the plane P of the cleaning head 20 and the longitudinal axis A of the handle 10; and the rear edge 24 being located on the side of the acute angel, V1, between the plane P of the cleaning head 20 and the longitudinal axis A of the handle 10.

In other embodiments, not shown, the profile of the cleaning head 20, seen from above or below as in FIG. 4, may be oval or circular. Also, it may be a square shape or even have a rectangular shape, where the extension of the cleaning head 20 in the direction of the first longitudinal axis, B, of the cleaning head 20 is smaller than the extension of the cleaning head 20 in the direction of the second elongate axis, C, of the cleaning head 20.

In preferred embodiments, the ribs 30 intersect the first longitudinal axis, B of the cleaning head 20.

Further, and as shown in FIGS. 4 and 6, preferably the one or more ribs 30 are V shaped (or arrow shaped). Preferably, the V or arrow-shape being formed such that the top of the V (the arrow-tip) points in the direction of the front edge 23, and the "legs" of the V point in the direction of the rear edge 24.

Figure 1A:
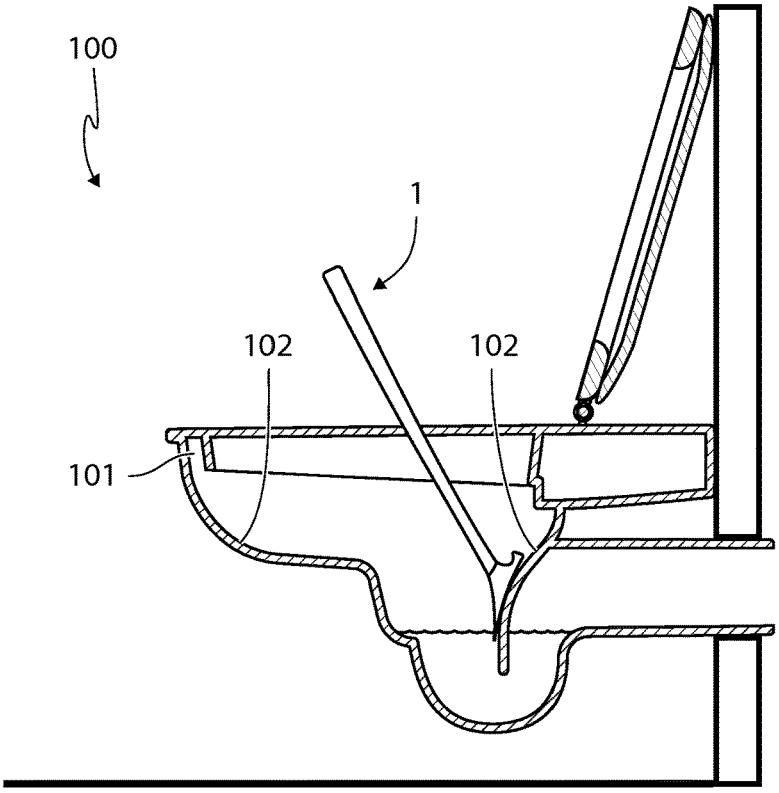
FIG. 1B shows the toilet bowl and toilet cleaning device of FIG. 1A, where the toilet cleaning device is in another position in the toilet bowl.

As can be seen in FIGS. 5, 8 and 9, the ribs 30, has a soft transition to the lower surface 22 of the cleaning head 20 in order to prevent dirt from settling in cracks or corners of the cleaning head 20. In FIG. 5 the ribs 30 are shown as having a symmetrical (along the ridge ribs 30) cross-sectional shape. However, preferably—and as shown in FIGS. 8 and 9 the ribs 30 may have an asymmetrical cross sectional shape, such that the front side of each of the ribs 30, i.e. the side of a rib 30 facing the front edge 23, has a steeper larger angle relative to the lower surface 22 than a rearward facing side of the rib 30. Thereby, when using the toilet cleaning device 1 (see FIGS. 1A and 1B) water flushing from above in the toilet bowl 100 (i.e. from the water inlet crevice 101) will easier pass over the ribs 30. Also this shape of the ribs, will increase the scrubbing ability when pushing the toilet cleaning device in the forward direction, while making it easier to drag the cleaning head in the rearward direction over the surface 102 to be cleaned.

As described above, the cleaning head 20 is a generally flat, plate-shaped structure. Preferably—and as shown in FIGS. 2, 3, 5-9—the transition portion 40 the toilet-cleaning device 1 forms a smooth, gradual transition between the handle 10 and the upper surface 21 of the cleaning head 20. Thus, the transition portion 40 forms a raised part of the upper surface 21.

The cavity 28 is formed in the lower surface 22 opposite to the transition-portion 40 and thereby opposite to the handle 10. Thereby, when the flange 29 is brought into contact with a surface 102 during use, and by a suitable choice of materials for the flange 29, the flange 29 may be brought to flex relative to the handle 10 and the transition portion 40, when a pressure is applied to the handle 10 along the longitudinal axis A thereof, and in the direction towards the cleaning head 20.

Thereby, via the flexing of the flange 29, the cavity portion 22' of the lower surface 22, may be pushed in a direction towards the plane P and surface 102, by manipulating the handle. Thereby, the cavity 28 may be at least partly evacuated from air. Further, this allows a contact between the cavity portion 22' of the lower surface 22, which receives forces directly from the handle 10, whereby an increased scrubbing effect may be achieved, while still allowing the flange 29 to provide a sweeping, less forceful contact between the surface 102 to be cleaned and the cleaning head 20 than with cavity portion 22' of the lower surface 22.

Further, in embodiments where ribs 30 are formed in the cavity 28, the ribs 30 will be located opposite to where the handle 10 connects to the cleaning head 20. Thereby a push on the handle 10—due to the flexibility of the flange 29—may bring the ribs 30 into contact with the surface 102. Thereby, because the ribs and the handle 10 are aligned, a push on the handle will efficiently push the ribs 30 toward the surface 102 to be cleaned, and an efficient scrubbing of the surface may be obtained.

Although, there may be no ribs or just one rib 30 in the cavity 28, in preferred embodiments there are two or three ribs. FIG. 5 shows to ribs 30 and the embodiments in FIGS. 8 and 9, show three. In other (not shown) embodiments, there may be four or more ribs 30. By having a plurality of ribs 30, when the cleaning head 20 is swept over a surface 102 to be cleaned in a direction parallel to the first longitudinal axis B of the cleaning head 20, dirt (not shown) on the surface 102 will experience a sequence of impacts by the ribs 30. Thereby, an increased scrubbing efficiency may be obtained.

In preferred embodiments of the toilet cleaning device 1, a scrubbing knob 34 is formed on a flange portion 21" of the upper surface 21 of the flange 29. The scrubbing knob 34 extends from the flange portion 21" of the upper surface 21' in a direction perpendicular to the plane P, and in a direction towards the handle 10.

The scrubbing knob 34 thereby forms a thickening of the flange 29 at a portion thereof, whereby the upper surface 21—or at least a portion thereof may also be used for scrubbing. Thereby, the toilet cleaning device 1 may also be used to clean/scrub between opposed surfaces, e.g. in the water inlet "crevice" 101 of a typical toilet bowl 100, see FIGS. 1A and 1B.

Preferably, and as shown in the figures, the scrubbing knob 34 is formed on the rear edge 24 of the flange 29 of the cleaning head 20, i.e. in a position of the flange 29, on the first longitudinal axis B of the cleaning head 20, and on the side of the handle 10, where the handle forms the acute angle V1 with the plane P. However, in other embodiments (not shown), other parts of the flange 29 may at the upper surface 21, alternatively or additional be provided with a similar scrubbing knob.

In preferred embodiments, the scrubbing knob 34 is formed as a bulge in one of the edges 23, 24, 25, 26 of the flange 29—preferably the rear edge 24—such that a rearward facing cavity 32 is formed under the rear edge 24. This will provide an increased flexibility of the scrubbing knob 34 and the portion of the flange 29, wherein it is provided. Further, the rearward facing cavity 32, and the flexibility it provides to the flange 29 at the rear edge 24, may allow air to enter into the cavity 28 and allow relieving of a vacuum formed in the space between the lower surface 22 of the cleaning head 20 and a surface 102 of the toilet bowl 100 to be cleaned. In some embodiments (not shown), a channel may be provided between the rearward facing cavity 32 and the cavity 28.

As shown in e.g. FIG. 6, the toilet cleaning device 1 may further comprise one or more slits 31 formed in an edge 23, 24, 25, 26 of the flange 29. The slits may also be called cut outs. In the embodiments shown in the figures, one slit 31 is provided in each of the side edges 25, 26. However, in other embodiments (not shown), more slits may be provided in each of the side edge 25, 26, and/or in the other edges, e.g. the front edge 23, or the rear edge 24.

The one or more slits divides the flange 29 into flange sections (which could also be called tongues, flaps or wings) 35, 36, 37, 38. The slits 31 thereby will allow the flange sections 35, 36, 37, 38 of the flange 29 to flex individually relative to each other and relative to the cavity 28, the transition portion 40, and the handle 10, as indicated by the double arrows in FIG. 6. Thereby, the flexibility of the flange 29, is increased, and the flange 29, or the individual flange sections 35, 36, 37, 38 thereof, may more easily adapt to any surface shape of a surface 102 to be cleaned. Further, the increased flexibility allows the individual flange sections 35, 36, 37, 38 to enter into cavities, cracks or slits (not shown) of the toilet bowl 100 to be cleaned. Thereby, more efficient cleaning may be obtained.

Further, the slits 31 may prevent or decrease a vacuum formed in the space between the cavity 28 and a surface 102 to be cleaned (e.g. the internal surface of a toilet bowl), during use of the toilet cleaning device 1, by allowing air to enter via the slits and/or due to the flexibility they provide to the flange 29. Such a vacuum may prevent movement of the cleaning head 20 of the toilet cleaning device 1. Thus the slits may prevent that the toilet cleaning device 1 gets sucked to the surface 102 to be cleaned/scrubbed.

In all embodiments of the toilet cleaning device 1, the shaft 13 of the handle 10 may be formed in a hard, rigid material. A suitable material could be polypropylene (PP) or ABS plastic. Also, materials such as metals or metal alloys may be used for the handle 10. Also, wood could be chosen. By a rigid, hard material in this context is to be understood, a material which provides sufficient strength to withstand bending and breaking when applying manual force for typical scrubbing/cleaning tasks in connection with sanitizing toilet bowls.

In all embodiments described above, the cleaning head 20, or at least portions thereof may preferably be formed in a material, which is soft and flexible. In all embodiments described above, the cleaning head 20, or at least portions thereof may preferably be formed in a material softer and more resilient than the handle 10, such as a thermoplastic elastomer TPE, rubber or even silicone.

Thermoplastic elastomers (TPE), sometimes referred to as thermoplastic rubbers, are a class of copolymers or a physical mix of polymers (usually a plastic and a rubber) which consist of materials with both thermoplastic and elastomeric properties. While most elastomers are thermosets, thermoplastics are in contrast relatively easy to use in manufacturing, for example, by injection moulding. Thermoplastic elastomers show advantages typical of both rubbery materials and plastic materials. The principal difference between thermoset elastomers and thermoplastic elastomers is the type of crosslinking bond in their structures. In fact, crosslinking is a critical structural factor which contributes to impart high elastic properties.

At least the flange 29 may be formed in the soft and flexible material described above. Thereby, the flange 29 or the section 35, 36, 37, 38 thereof may move relative to the handle and to each other. Thereby, efficient scrubbing by the toilet-cleaning device 1 may be obtained.

In the embodiment shown in FIGS. 8 and 9, the handle 10 comprises a head core portion 14 forming an extension of the elongate shaft 13 at the distal end 12 thereof. The head core portion 14 extends into the cleaning head 20 to form a connection thereto. In the FIG. 8 embodiment, the head core portion 14 is formed integrated with the shaft 13 of the handle 10, and may therefore be formed in the same materials as described above. In the embodiment shown in FIG. 9, the head core portion 14 is formed as a separate part which is connected to the distal end 12 of the shaft 13 of the handle 10 during manufacture by suitable means, e.g. by moulding or mechanical connections. In this embodiment the head core portion 14 may be formed in material, which is different from that of the handle 10. However, preferably the head core portion 14 is still formed from a hard, rigid material similar to the materials described for the handle 10 above.

In both of the embodiments shown in FIGS. 8 and 9 the transition portion 40 and the flange 29 may be formed in one integrated piece, by moulding onto the head core portion 14 of the handle 10. Thus, the transition portion 40 and the flange 29 forms a mantle 50 on the head core portion 14. This mantle 50 is preferably formed in a material as described for the cleaning head 20 above, i.e. in a soft, flexible material such as TPE.

As shown in the FIGS. 8 and 9, the mantle 50 formed on the head core portion 14, may further comprise a portion on the lower side of the head core portion 14, such that the cavity 28 is formed in this portion of the mantle 50. Preferably, and as shown in FIGS. 8 and 9, the ribs 30 are also formed integrated with the mantle 50.

However, in other embodiments (not shown) the ribs 30 may alternatively be formed on the lower side of the head core portion 14. In this version, the ribs 30 may either extend through a portion of the mantle 50, which is located at the lower side head core portion 14, or the mantle 50 may be formed such that there is an opening exposing the lower side/surface of the head core portion 14. In further embodiments (not shown) the mantle 50 may have a portion covering most of the lower surface/side of the head core portion 14, and one or more ribs 30 being formed on the lower side/surface of the head core portion 14, and extending through the mantle 50, and one or more ribs 30 being formed on the portion of the mantle 50, which covers the lower side of the head core portion 14. Thereby, alternating soft and rigid ribs 30 could be obtained, in order to be able to deal with/scrub different types of dirt.

In other (not shown) embodiments, the cleaning head 20 may be formed as an attachable/detachable unit which may be connectable to the handle 10, by suitable mechanical connection means. As shown in FIG. 9 the head core portion 14 has an upwardly (or proximally) extending portion, forming a male part cooperating with a female portion of the distal part of the handle 10. Preferably, a mechanical connection is formed between the cleaning head 20 and the handle 10, allowing the replacement of the cleaning head 20, i.e. the cleaning head is attachable and detachable to/from the handle 10. This may be achieved by e.g. mating threads on the handle 10 and the cleaning head 20, or via various turn and lock or snap-lock connections.

In all of the above embodiments, the surface properties of at least the cleaning head 20 are preferably such that a closed, unporous surface is obtained. Thus the cleaning head surface has a smooth unbroken surface. This may be obtained by a suitable choice of materials. Thereby, it is avoided that dirt sticks to the toilet-cleaning device 1 and it may itself be easily rinsed after use.

In further embodiments, not shown, the handle 10 may comprise a reservoir for storing and dispensing a cleaning substance, e.g. a liquid cleaning substance. The handle 10 may further comprise means for dispensing a dose of the cleaning substance, e.g. by squeezing a portion of the handle or by activating a button formed in the handle 10. The cleaning substance may preferably be dispensed through the cleaning head 20, e.g. into the cavity 28. A suitable liquid communication may be provided between the reservoir and an outlet for the cleaning substance at the cleaning head 20 in order to enable such dispensing of a cleaning substance. In other (also not shown) embodiments, a reservoir for a cleaning substance, may be provided in the cleaning head 20, e.g. inside the above mentioned head core portion 14. The reservoir may in this instance be connected to dosage activating means provided on/in the handle 10 to dispense a dose of cleaning substance through the cleaning head 20.

The cleaning substance may be a liquid soap or a disinfectant.

In any of the above described embodiments of the toilet cleaning device 1, portions of the cleaning head 20 or the handle 10, may be formed in a material, where a sent-substance or a disinfecting substance is integrated in the material, such that the material may during use of the toilet cleaning device release sent molecules and/or molecules of a disinfectant. Thus, a sent additive (and/or a disinfectant additive) may be incorporated in the material used for the handle 10 during manufacture of the handle 10. Also, a sent additive (and/or a disinfectant additive) may be incorporated in the material used for the cleaning head 20 during manufacture of the cleaning head 20. In a preferred embodiment the sent additive (and/or a disinfectant additive) is incorporated in the cleaning head 20. In a further embodiment, a sent additive may be incorporated in the mantle 50 of the cleaning head 20.

Returning now to FIGS. 1A and B, a toilet-cleaning device 1 as in any of the embodiments described above, may be applied in a method where the lower surface 22 of the cleaning head of the toilet cleaning device 1 is placed against an inner surface of a toilet bowl; pressure is applied to the handle 10 in a direction towards an inner surface 102 of the toilet bowl 100; the cleaning head 20 is moved over the inner surface 102 of the toilet bowl 100;

The flexible sections 35, 36, 37, 38 of the flange 29 will remove dirt and spread cleaning substance over the surface 102 by scrubbing. If dirt is severely adhered to the surface, the pressure applied to the handle 10 in a direction towards an inner surface of the toilet bowl 100 may be increased, bringing the ribs 30 in the cavity 28 into contact with the surface and the dirt and using the ribs to scrub away the resilient parts of the dirt.

A portion of the flange 29 flexible sections 35, 36, 37, 38 may be entered into a water outlet crevice 101 of the toilet bowl 100, to clean therein.

Figure 1B:
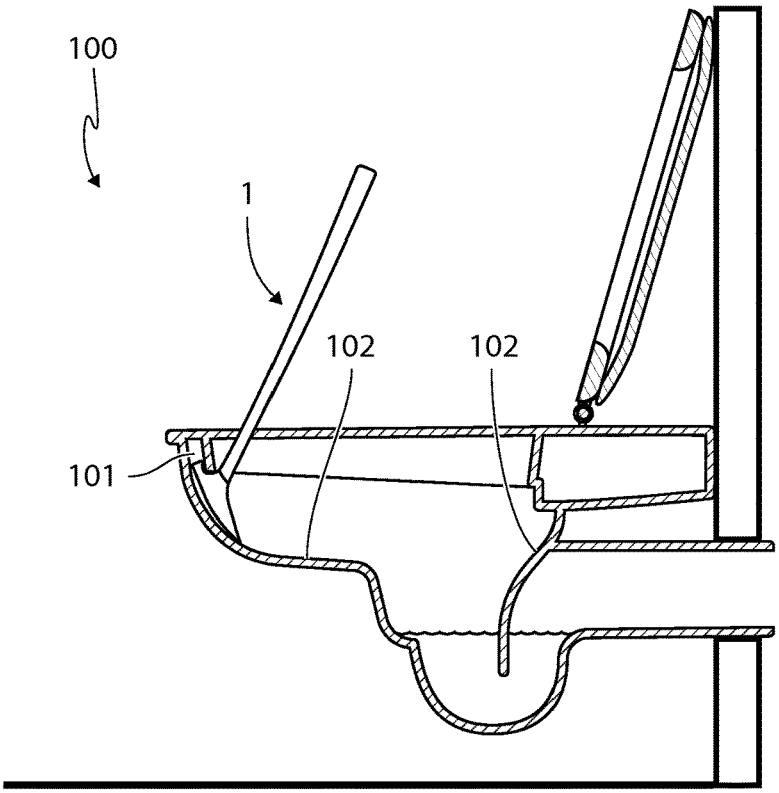

As shown in FIG. 1B, the knob 34 may in an embodiment of the method, be used to enter into a water outlet crevice 101 of the toilet bowl 100, to clean therein.

Figure 10A:
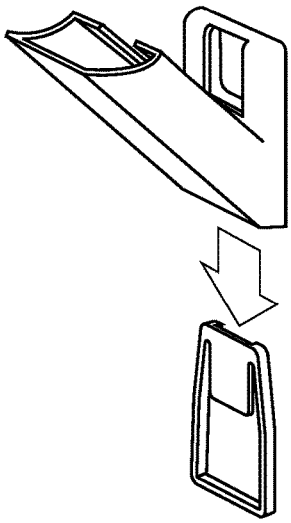
FIGS. 10A-C, in perspective view, shows a toilet cleaning device according to the present invention with a holder for storing the toilet cleaning device, when not in use.
Figure 10B:
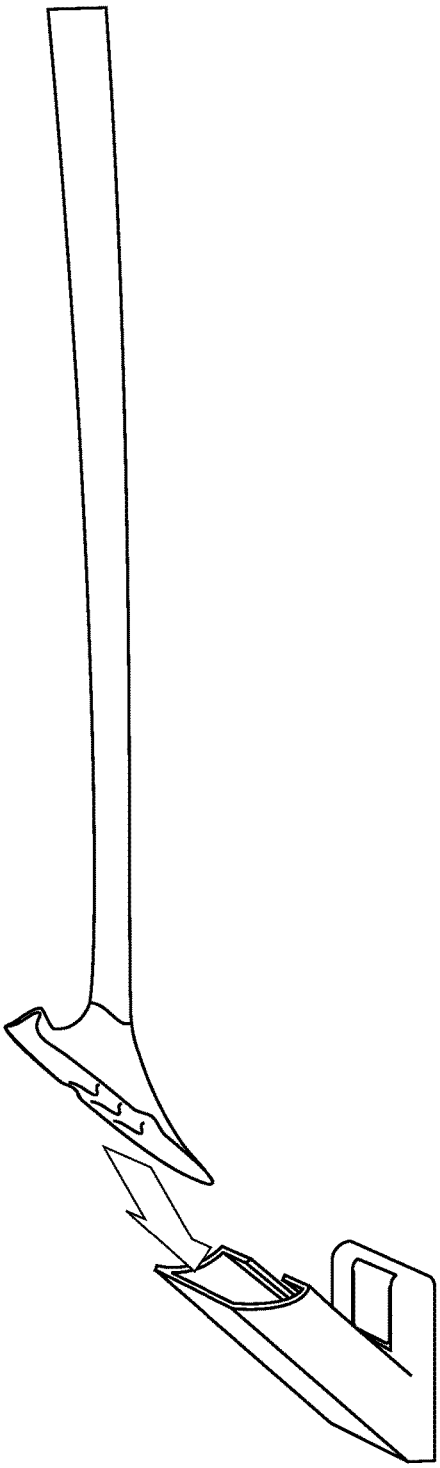
Figure 10C:
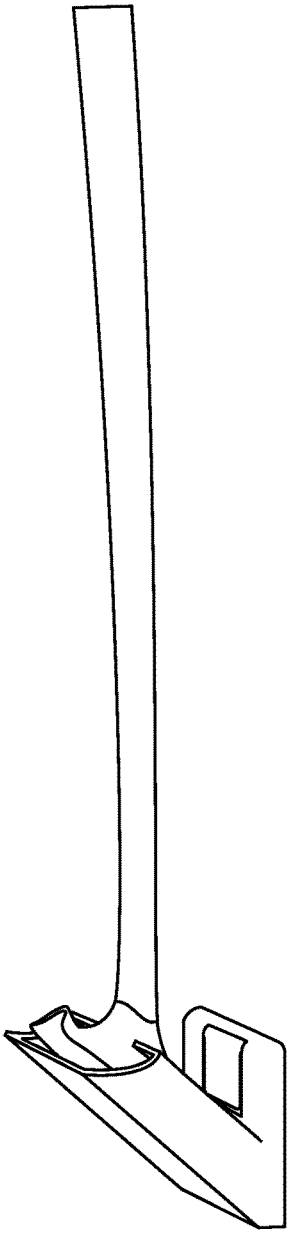

Referring now to FIGS. 10A-C, the present invention also relates to a combination of a toilet cleaning device in any of the embodiments described above with a holder for storing the toilet cleaning device, when the toilet cleaning device is not in use. FIG. 10A shows details of the holder. The holder comprises a wall mount part and a holding part. The wall mount part is shown on the bottom of FIG. 10A, and comprises a plate adapted for cooperating with a wall (not shown). The plate may be mounted on a wall by the aid of e.g. screws or other fasteners. Alternatively, the plate may be mounted by an adhesive, e.g. a double adhesive tape. The wall mount part further comprises a chute for receiving a flange on the back side of the holding part, which flange is adapted for cooperating with the chute. The holding part is the upper item shown in FIG. 10A. The arrow in FIG. 10A indicates how the flange of the holding part may be slid into the chute of the wall mount part to connect the two parts. FIGS. 10B and C shows holding part and the wall mount part, when connected. FIG. 10B further shows a toilet cleaning device as described above being inserted into a holder, the insertion being indicated by the arrow in FIG. 10B. The holding part of the holder comprises a dock for the cleaning head 20 of the toilet cleaning device. The dock is formed as an elongate box shaped structure which at one end is connected to a plate part of the holding part. The plate part is adapted for forming a shield over the plate of the wall mount part, and comprises the flange for connecting to the wall mount part, as described above. The box shaped dock is preferably formed at an angle to the plate part of the holding part of the holder. This angle corresponds to the angle V1 between the cleaning head 20 (plane P) and the handle 10 (axis A), such that when the cleaning head 20 of the toilet cleaning devise 1 is inserted into the dock of the holder, the handle 10 of the toilet cleaning device 1 is vertical, as shown in FIG. 10C. A slit is arranged in and through an upper surface of the box-shaped dock, which slit is adapted for receiving the handle 10 or the transition portion 40 of the toilet cleaning device 1. This allows the toilet cleaning device to be arrested in the dock of the holder. FIG. 10C shows a toilet cleaning device arrested in the holder Although the teaching of this application has been described in detail for the purpose of illustration, it is understood that such detail is solely for that purpose, and variations can be made therein by those skilled in the art without departing from the scope of the teaching of this application.

The term "comprising" as used in the claims does not exclude other elements or steps. The term "a" or "an" as used in the claims does not exclude a plurality. The single processor or other unit may fulfill the functions of several means recited in the claims.

LIST OF REFERENCE NUMBERS

1 toilet cleaning device
10 elongate handle
11 first/proximal end of elongate handle
12 second/distal end of elongate handle
13 shaft of elongate handle
14 head core portion
20 cleaning head
21 upper surface/upper side of cleaning head
22 lower surface/lower side of cleaning head
23 front edge of cleaning head
24 rear edge of cleaning head
25 side edge of cleaning head
26 side edge of cleaning head
27 perimeter of cleaning head
28 cavity of cleaning head
29 flange of cleaning head
30 ribs
31 slit/cut out
34 scrubbing knob
35 wing/flap/section of flange
36 wing/flap/section of flange
37 wing/flap/section of flange
38 wing/flap/section of flange
40 transition-portion/section/joint-portion/connecting piece
50 mantle
100 toilet bowl
101 crevice/water inlet
102 surface

The invention claimed is:

1. A toilet cleaning device, comprising:
a handle; and
a cleaning head;
said handle comprising an elongate shaft with opposite first and second ends, and a longitudinal axis;
said cleaning head comprising
an upper surface connecting to said second end of said handle,
a lower surface opposite to said handle,
a transition-portion forming a transition between said handle and the upper surface of said cleaning head; and
a flange extending outward from said transition portion;
said lower surface comprising an outer perimeter, said outer perimeter defining a plane,
said longitudinal axis of said elongate shaft, forming an acute angle with said plane,
wherein a cavity is formed in at least part of said lower surface of said cleaning head within said outer perimeter; and
wherein one nor more ribs are formed on said lower surface of said cavity.

2. The toilet cleaning device according to claim 1, wherein said cleaning head has a flat, elongate shape with a first longitudinal axis, said first longitudinal axis being parallel with both said plane defined by said perimeter, and said longitudinal axis of said shaft, and wherein said ribs intersect said-first longitudinal axis of said head.

3. The toilet cleaning device according to claim 1, wherein said one or more ribs are V shaped.

4. A toilet cleaning device, comprising:
a handle; and
a cleaning head;
said handle comprising an elongate shaft with opposite first and second ends, and a longitudinal axis;
said cleaning head comprising
an upper surface connecting to said second end of said handle,
a lower surface opposite to said handle,
a transition-portion forming a transition between said handle and the upper surface of said cleaning head; and
a flange extending outward from said transition portion;
said lower surface comprising an outer perimeter, said outer perimeter defining a plane,
said longitudinal axis of said elongate shaft, forming an acute angle with said plane,
wherein a cavity is formed in at least part of said lower surface of said cleaning head within said outer perimeter; and
wherein a scrubbing knob is formed on an upper surface of said flange, said scrubbing knob extending from said upper surface in a direction perpendicular to said plane, and in a direction towards said handle.

5. The toilet cleaning device, according to claim 4, wherein the knob is formed in a position on said flange between said handle and said flange where said handle forms said acute angle with said plane of said cleaning head.

6. A toilet cleaning device, comprising:
a handle; and
a cleaning head;
said handle comprising an elongate shaft with opposite first and second ends, and a longitudinal axis;
said cleaning head comprising
an upper surface connecting to said second end of said handle,
a lower surface opposite to said handle,
a transition-portion forming a transition between said handle and the upper surface of said cleaning head; and
a flange extending outward from said transition portion;
said lower surface comprising an outer perimeter, said outer perimeter defining a plane,
said longitudinal axis of said elongate shaft, forming an acute angle with said plane,
wherein a cavity is formed in at least part of said lower surface of said cleaning head within said outer perimeter; and
wherein one or more slits are formed in an edge of said flange.

* * * * *